US009605918B1

(12) United States Patent
Ballard

(10) Patent No.: US 9,605,918 B1
(45) Date of Patent: Mar. 28, 2017

(54) RIFLE MAGAZINE WITH RELEASE LEVER ACTUATOR

(71) Applicant: Pro Mag Mfg., Inc., Phoenix, AZ (US)

(72) Inventor: Michael Wayne Ballard, Surprise, AZ (US)

(73) Assignee: PRO MAG MFG., INC., Phoenix, AZ (US)

( * ) Notice: Subject to any disclaimer, the term of this patent is extended or adjusted under 35 U.S.C. 154(b) by 0 days.

(21) Appl. No.: 14/941,900

(22) Filed: Nov. 16, 2015

(51) Int. Cl.
*F41A 9/65* (2006.01)

(52) U.S. Cl.
CPC ..... *F41A 9/65* (2013.01)

(58) Field of Classification Search
CPC ..... F41A 9/65–9/78
See application file for complete search history.

(56) References Cited

U.S. PATENT DOCUMENTS 2,081,235 A * 5/1937 Hillyard ..... F41A 9/65 42/18
2,275,213 A * 3/1942 Wise ..... F41A 9/65 42/18
5,588,241 A * 12/1996 Hurley ..... F41A 9/65 42/18
6,606,811 B1 * 8/2003 Olson ..... F41A 17/36 42/50
7,941,955 B2 * 5/2011 Stone ..... F41A 9/25 42/50
8,122,632 B2 * 2/2012 Bentley ..... F41A 9/65 42/6
9,400,148 B2 * 7/2016 Pittman ..... F41A 9/72

OTHER PUBLICATIONS cheaperthandirt.com, "ProMag SKS Magazine 7.62×39mm 40 Round Capacity Polymer Black SKS-A3," http://www.cheaperthandirt.com/product/2-MGPMSKS-A3, Accessed May 12, 2015.

(Continued)

*Primary Examiner* — Stephen M Johnson
*Assistant Examiner* — Joshua Semick
(74) *Attorney, Agent, or Firm* — Bennet K. Langlotz; Langlotz Patent & Trademark Works, Inc.

(57) ABSTRACT

Rifle magazines with release lever actuators have a magazine body defining a chamber for receiving ammunition, the body having a catch feature adapted for selectable engagement by the magazine release latch, a latch actuator element mounted to the magazine body proximate to the catch feature, and the latch actuator element being movable with respect to the body such that movement of the latch actuator element motivates the magazine release latch from the secured position to the released position. The latch actuator element maybe pivotally connected to the magazine body. The latch actuator element may have a first portion proximate the catch feature, and a second portion remote from the catch feature. The latch actuator may have an intermediate portion pivotally connected to the magazine body. The magazine may have major planar sidewalls, and the latch actuator may pivot on a pivot axis perpendicular to the sidewalls.

11 Claims, 21 Drawing Sheets

(56) References Cited

OTHER PUBLICATIONS

MWG Company, "Sadlak Industries M14 Tactical Magazine Release Latch," http://mwgco.com/ar-15_accessories/product/SIL-140040.html, Accessed May 5, 2015.
Catmandoo, "TALON mag release installed," http://sksboards.com/smf/index.php?topic=91256.0, Published Aug. 6, 2011, Accessed May 12, 2015.
Tapco, "SKS Extended Magazine Catch," http://tapco.com/products/sks/index.php?_a=viewProd&productId=216, Copyright 2010, Accessed May 12, 2015.

* cited by examiner

RIFLE MAGAZINE WITH RELEASE LEVER ACTUATOR

FIELD OF THE INVENTION

The present invention relates to firearms, and more particularly to a rifle magazine with release lever actuator.

BACKGROUND OF THE INVENTION

A magazine is an ammunition storage and feeding device within, or attached to, a repeating firearm. The magazine functions by moving the cartridges stored in the magazine into a position where they may be chambered by the action of the firearm. Most magazines designed for use with a reciprocating bolt firearm utilize a set of feed lips which stops the vertical motion of the cartridges out of the magazine but allows one cartridge at a time to be pushed forward (stripped) out of the feed lips by the firearm's bolt into the chamber.

Some form of spring and follower combination is almost always used to feed cartridges to the lips, which can be located either in the magazine (most removable box magazines) or built into the firearm (fixed box magazines). A box (or "stick") magazine, the most popular type of magazine in modern rifles and handguns, stores cartridges in a straight or gently curved column, either one above the other or staggered zigzag fashion. As the firearm cycles, cartridges are moved to the top of the magazine by a follower driven by spring compression to either a single feed position or alternating feed positions. In most firearms, the magazine follower engages a slide-stop to hold the slide back and keep the firearm out of battery when the magazine is empty and all rounds have been fired. Box magazines may be integral to the firearm or removable.

A detachable box magazine is a self-contained mechanism capable of being loaded or unloaded while detached from the host firearm. They are inserted into a magazine well in the firearm receiver usually below the action, but occasionally positioned to the side or on top. When the magazine is empty, it can be detached from the firearm and replaced by another full magazine. This significantly speeds the process of reloading, allowing the operator quick access to ammunition. This type of magazine may be straight or curved, the curve being necessary if the rifle uses rimmed ammunition or ammunition with a tapered case.

The SKS is a Soviet semi-automatic carbine chambered for the 7.62×39 mm round, designed in 1943 by Sergei Gavrilovich Simonov. The original design of the SKS included an integral 10 box magazine fed from a stripper clip. However, rounds stored in the magazine can be removed by depressing a magazine catch located forward of the trigger guard, which opens the floor of the magazine and enables the rounds inside to fall out. The stripper clip is capable of being reloaded and used multiple times, but was usually discarded in military usage.

The SKS has become a popular civilian firearm, especially in Canada and the United States. Because of the firearm's relatively low cost and widespread availability and usage, the SKS has spawned a growing market for both replacement parts and accessories. Many aftermarket parts are available to modify the carbine, including removable, higher capacity magazines of 30 rounds or more that replace the integral 10-round box magazine. One example of such a magazine is the SKS-A3 40 round magazine manufactured by ProMag Industries of Phoenix, Ariz. The SKS-A3 has a front magazine extension that engages a magazine retainer in the SKS and a rear catch that is engaged by the SKS' magazine catch to releasably attach the magazine.

The disadvantage of all prior art removable SKS magazines is the difficulty of removing them because of the poor ergonomics of the legacy SKS magazine catch. The requirement to pull in the magazine catch, which is located forward of the trigger guard, creates the risk that the user could inadvertently pull the trigger instead of releasing the magazine. The legacy SKS magazine catch is also relatively small and difficult to grasp, and the user is required to use both hands to remove the magazine. While this was not a major issue when the magazine catch was rarely accessed, the design presents a problem when the magazine catch must be routinely used to disengage empty magazines from the SKS. The problem is sufficiently serious that a variety of products have been invented that attempt to make the legacy SKS magazine catch more ergonomic. One such example is the SKS Extended Magazine Catch manufactured by TAPCO of Kennesaw, Ga. The disadvantage of these products is they often make the magazine catch even more closely resemble the trigger, creating even more risk the user could inadvertently pull the trigger instead of releasing the magazine.

An example of a firearm with a more ergonomically favorable magazine release design is the M14 rifle. The M 14 features a rear-facing thumb-actuated magazine release. Not only is the magazine release pushed forward, which makes it unlike the trigger that is pulled rearward, but the magazine can be removed one handedly.

Therefore, a need exists for a new and improved rifle magazine with release lever actuator that enables one-handed release of the magazine and decreases the risk of an inadvertent trigger pull. In this regard, the various embodiments of the present invention substantially fulfill at least some of these needs. In this respect, the rifle magazine with release lever actuator according to the present invention substantially departs from the conventional concepts and designs of the prior art, and in doing so provides an apparatus primarily developed for the purpose of enabling one-handed release of the magazine and decreasing the risk of an inadvertent trigger pull.

SUMMARY OF THE INVENTION

The present invention provides an improved magazine with release lever actuator, and overcomes the above-mentioned disadvantages and drawbacks of the prior art. As such, the general purpose of the present invention, which will be described subsequently in greater detail, is to provide an improved magazine with release lever actuator that has all the advantages of the prior art mentioned above.

To attain this, the preferred embodiment of the present invention essentially comprises a magazine body defining a chamber for receiving ammunition, the body having a catch feature adapted for selectable engagement by the magazine release latch, a latch actuator element mounted to the magazine body proximate to the catch feature, and the latch actuator element being movable with respect to the body such that movement of the latch actuator element motivates the magazine release latch from the secured position to the released position. The latch actuator element maybe pivotally connected to the magazine body. The latch actuator element may have a first portion proximate the catch feature, and a second portion remote from the catch feature. The latch actuator may have an intermediate portion pivotally connected to the magazine body. The magazine may have major planar sidewalls, and the latch actuator may pivot on a pivot axis perpendicular to the sidewalls. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
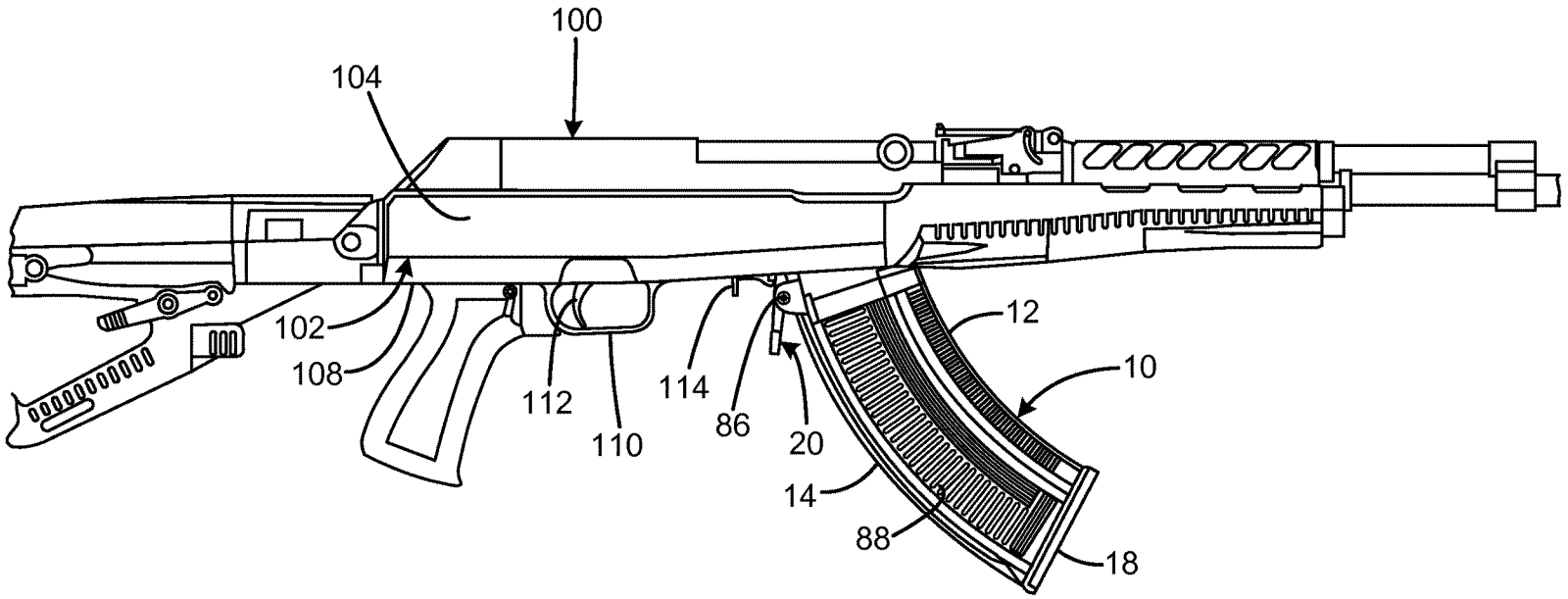
FIG. 1 is a right side view of the current embodiment of the magazine with release lever actuator constructed in accordance with the principles of the present invention installed on a SKS carbine.
Figure 2:
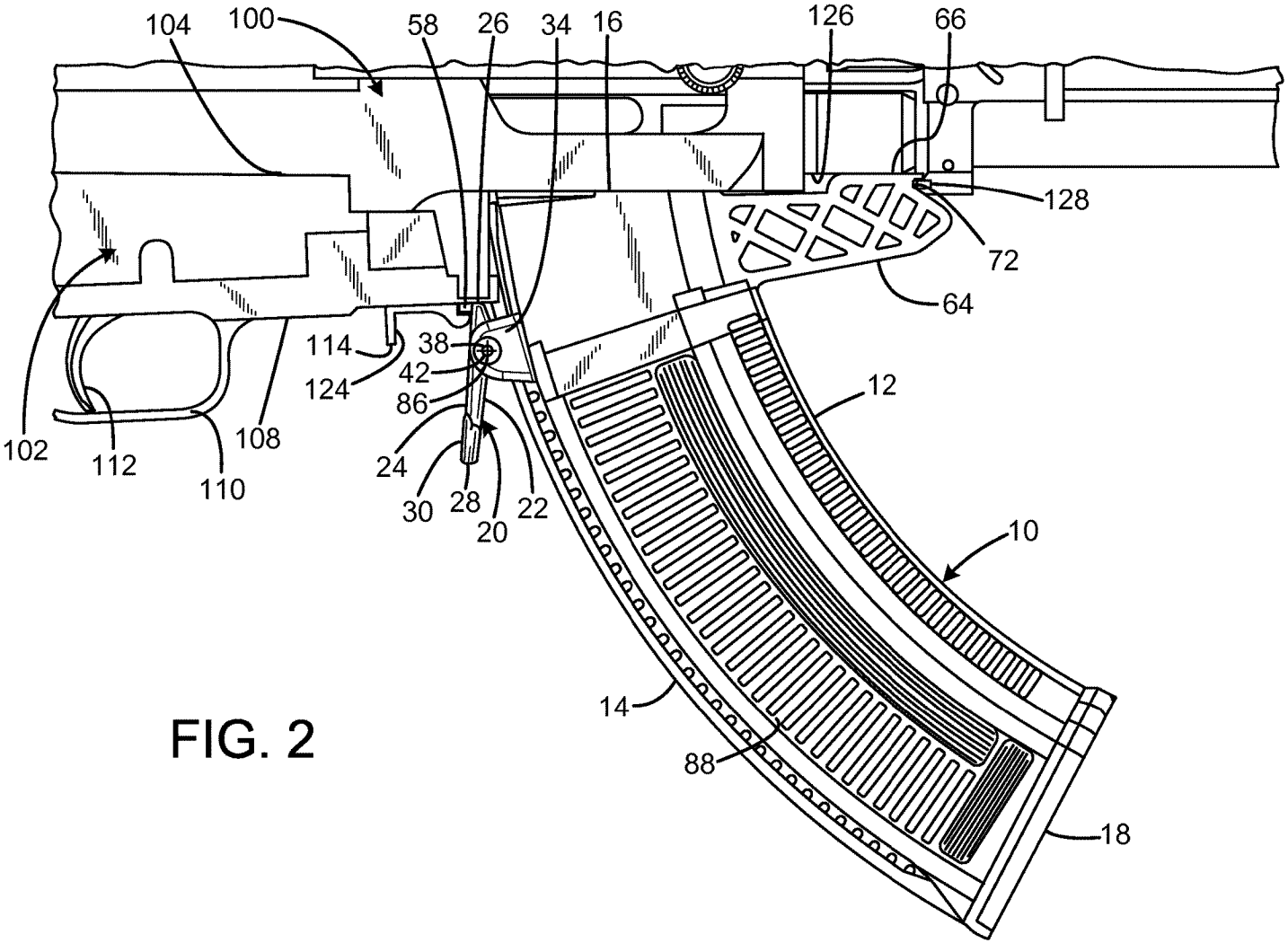
FIG. 2 is a right side view of the current embodiment of the magazine with release lever actuator of FIG. 1 installed on a SKS carbine. The SKS is shown in section.
Figure 3:
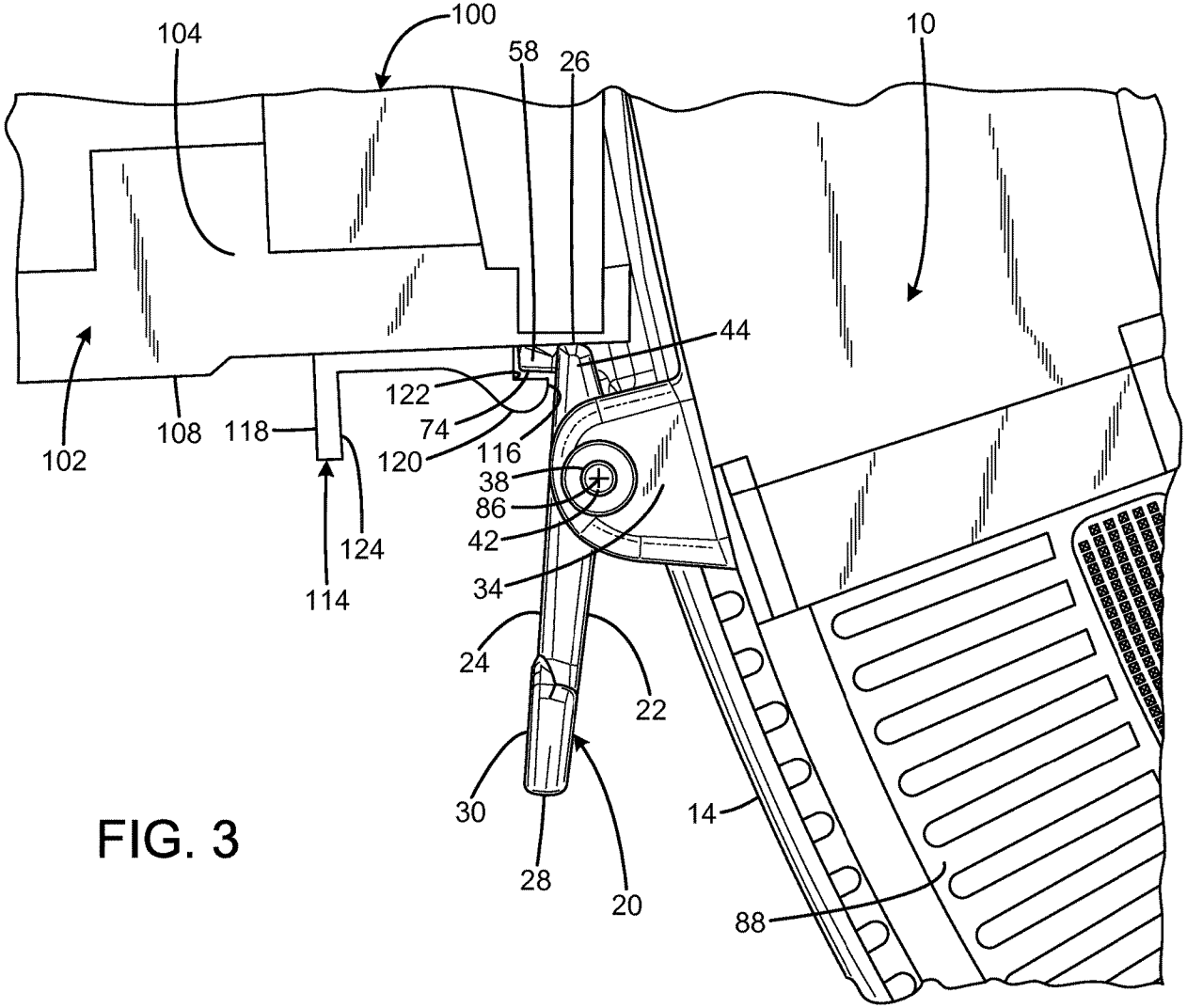
FIG. 3 is an enlarged partial view of FIG. 2.
Figure 4A:
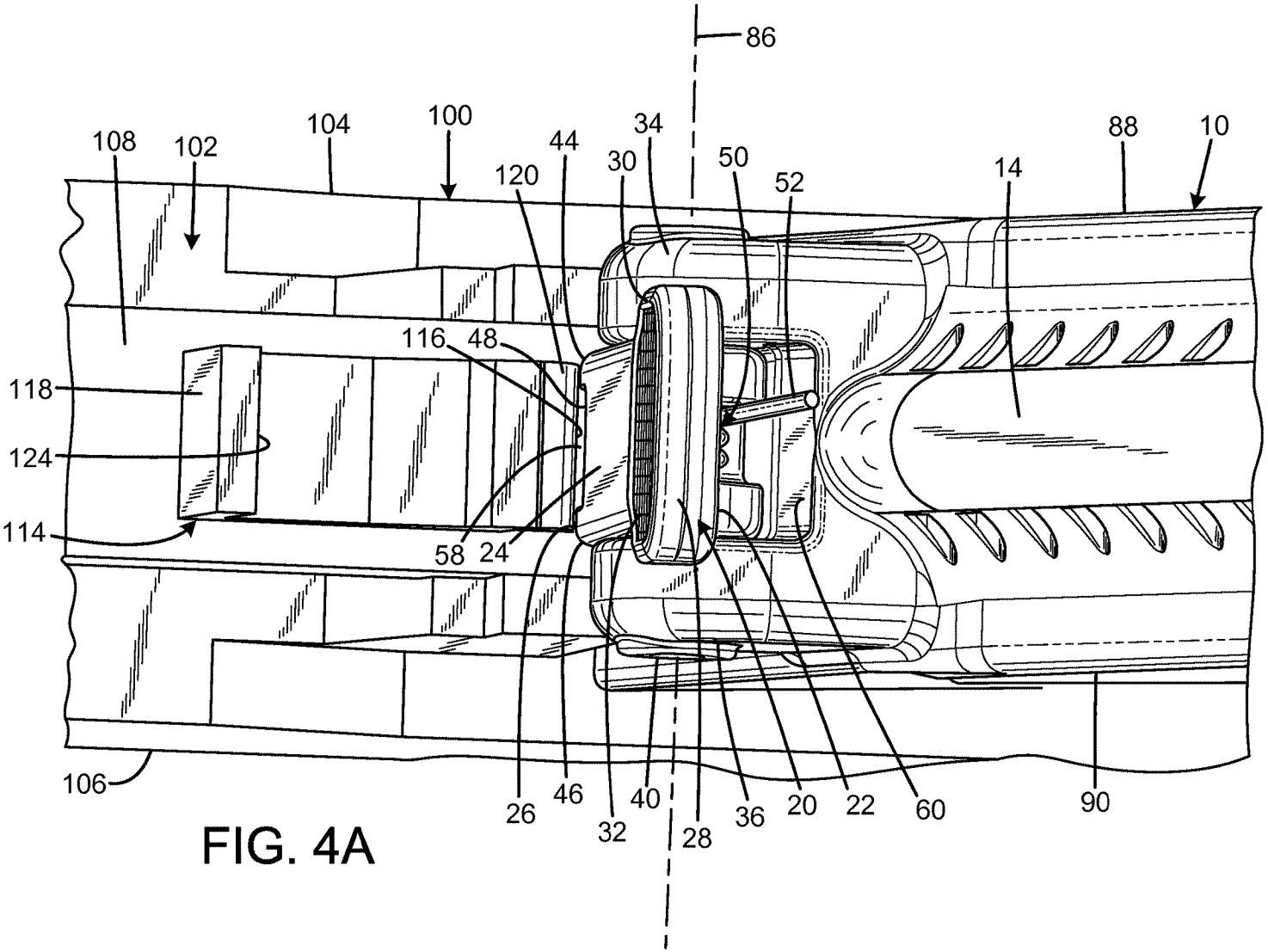
FIG. 4A is a bottom isometric view of the magazine with release lever actuator of FIG. 1 installed on a SKS carbine.
Figure 4B:
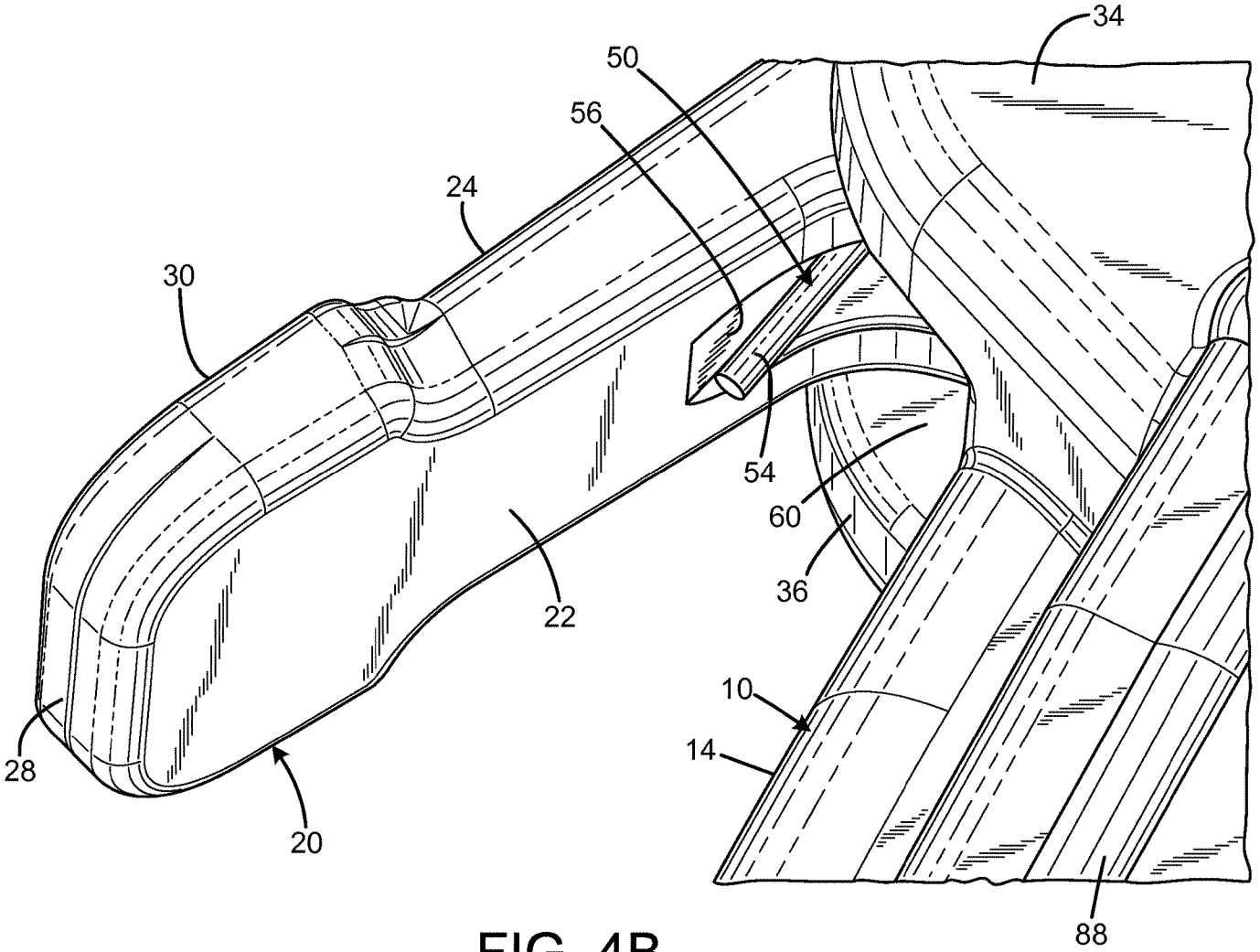
FIG. 4B is a right side isometric enlarged view of the magazine with release lever actuator of FIG. 1.
Figure 5:
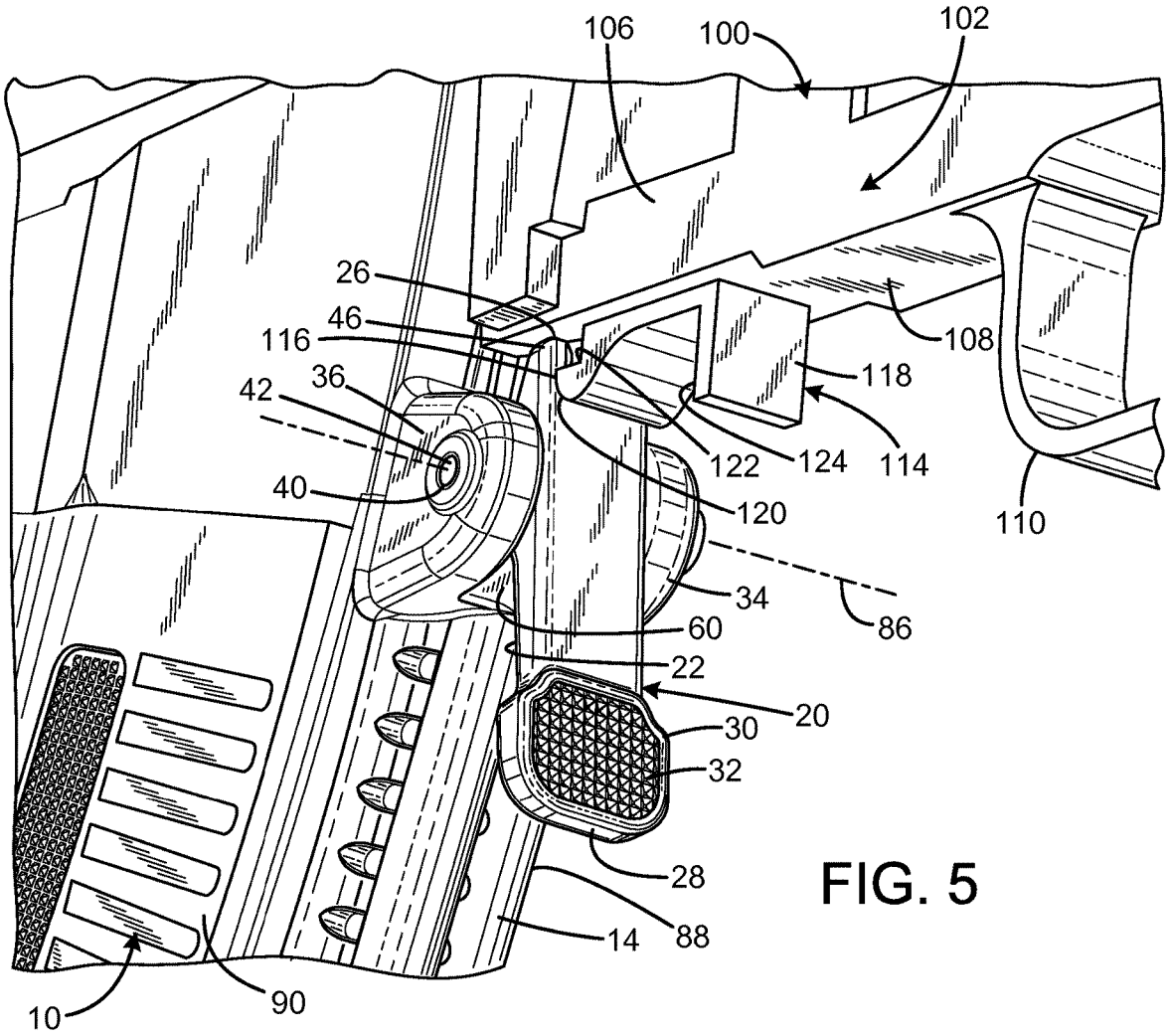
FIG. 5 is a rear isometric view of the magazine with release lever actuator of FIG. 1 installed on a SKS carbine.
Figure 6:
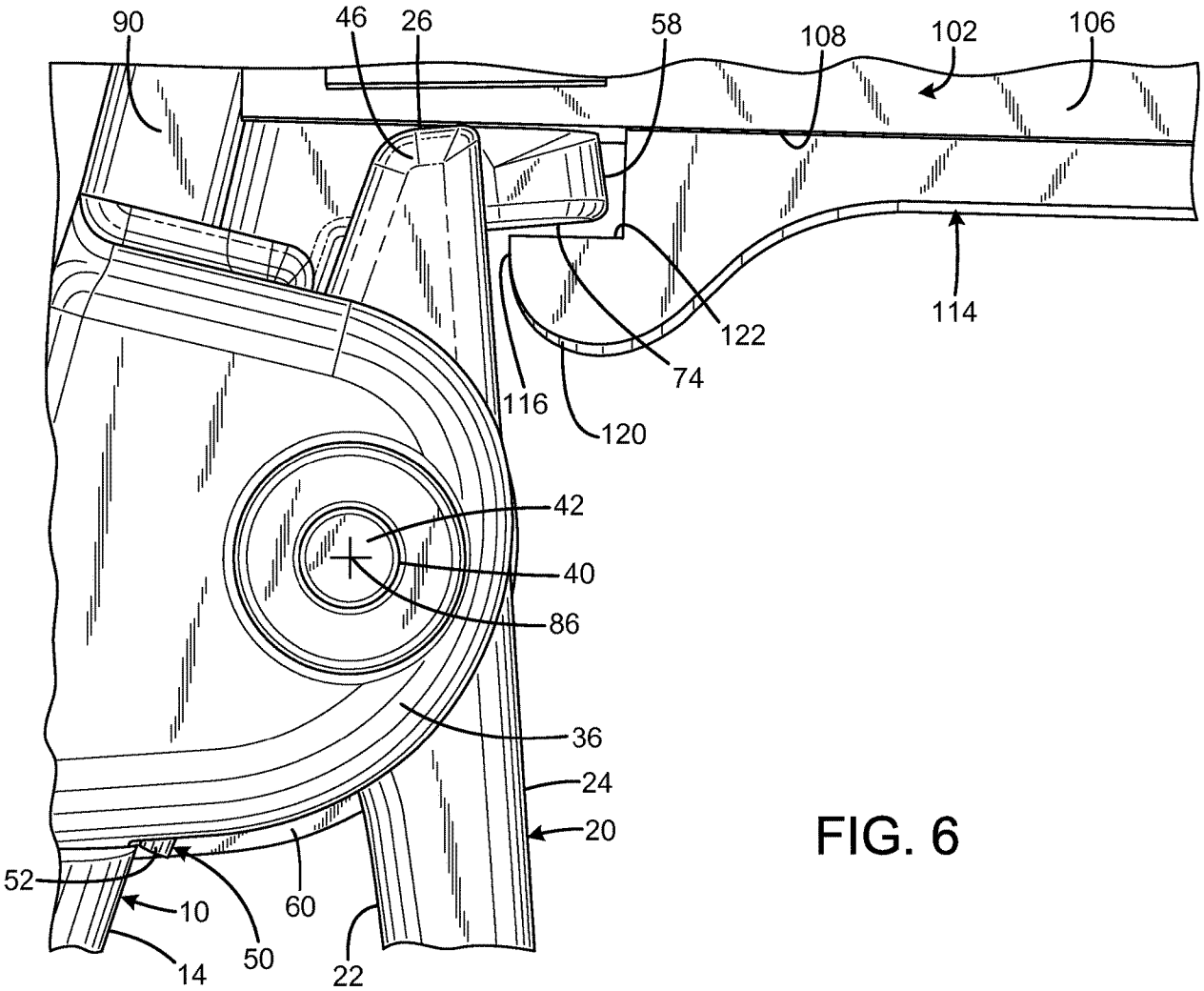
FIG. 6 is a left side view of the current embodiment of the magazine with release lever actuator of FIG. 1 installed on a SKS carbine. The SKS is shown in section.

An embodiment of the magazine with release lever actuator of the present invention is shown and generally designated by the reference numeral 10.

FIGS. 1-6 and 14-17 illustrate the improved magazine with release lever actuator 10 of the present invention. More particularly, the magazine is depicted installed on a SKS carbine 100. The magazine is generally tubular and has a front 12, rear 14, top 16, bottom 18, and major planar right and left side walls 88, 90. The rear of the magazine is an elongated wall that includes a right ear 34 and a left ear 36 separated by a slot 60. The right ear defines a right aperture 38. The left ear defines a left aperture 40. Opposing ends of an axle 42 are received within the right and left apertures 38, 40. A rear catch 58 having a bottom 74 protrudes rearwardly from the rear of the magazine above the right and left ears 34, 36. A front magazine extension 64 protrudes forwardly from the top front of the magazine. The front magazine extension has a top 66 that defines a forward facing notch 72. The magazine has a hollow interior 68, and includes right feed lip 70 and left feed lip 76 at the top of the magazine. The right feed lip and left feed lip serve to guide the uppermost cartridge (not shown) into the SKS carbine as the cartridge emerges upwards from the interior of the magazine.

A release lever actuator 20 is pivotally mounted to the magazine 10 within the slot 60 on the axle 42. The release lever has a front 22, rear 24, top 26, and bottom 28. The top front of the release lever includes a right ear 78 and a left ear 80. The right ear defines a right aperture 82, and the left ear defines a left aperture 84. The axle 42 is received within the right and left apertures 82, 84 and defines a pivot axis 86. The pivot axis is perpendicular to the right and left side walls 88, 90 of the magazine. A pocket 56 is defined by the front of the release lever between the right and left ears 78, 80. The rear of the bottom of the release lever defines a thumb pad 30 with serrations 32. The serrations prevent a user's thumb from inadvertently sliding off of the thumb pad. The top of the release lever defines a right prong 44 and a left prong 46 separated by a slot 48. A torsion spring 50 is mounted on the axle within the slot 60 between the rear 14 of the magazine and the front 22 of the release lever. The torsion spring has a front spring leg 52 that contacts the rear of the magazine and a rear spring leg 54 that is received within the pocket. The torsion spring biases the top of the release lever forwardly towards the rear of the magazine and biases the bottom of the release lever rearwardly away from the rear of the magazine (the "engaged position" the release lever assumes when the magazine is installed on a SKS carbine 100).

The SKS carbine 100 includes a lower receiver 102 having a right 104, a left 106, and a bottom 108. A trigger guard 110 protrudes from the bottom of the lower receiver and encircles a trigger 112. A spring loaded magazine latch 114 protrudes from the bottom of the lower receiver forward of the trigger guard. The magazine latch 114 has a front 116, rear 118, and is spring-biased forwardly towards the rear 14 of the magazine 10 into the "engaged position." The front of the magazine latch defines a cam surface 120 and a notch 122. The rear of the magazine latch defines a hook 124. The bottom of the lower receiver also defines a slot 126 and a magazine retainer 128 in communication with the slot. The slot 126 and the magazine retainer are located forward of the magazine latch.

When the magazine 10 is installed in the SKS carbine 100, both the magazine latch 114 and the release lever actuator 20 are in the "latched/engaged position." The top 26 of the release lever is pivoted forward into contact with the rear 14 of the magazine such that the magazine latch can assume the magazine latch's forwardmost position. The bottom 74 of the rear catch is received within the notch 122 in the front 116 of the magazine latch. The front of the magazine latch obstructs downward movement of the rear catch, thereby releasably retaining the top 16 rear 14 of the magazine within the bottom 108 of the lower receiver 102. The top 66 of the front magazine extension 64 is releasably retained within the slot 126 in the bottom of the lower receiver by the engagement of magazine retainer 128 within notch 72. The magazine retainer secures the front of the original SKS box magazine, and no modification of the magazine retainer is required for use with the magazine 10.

Figure 7:
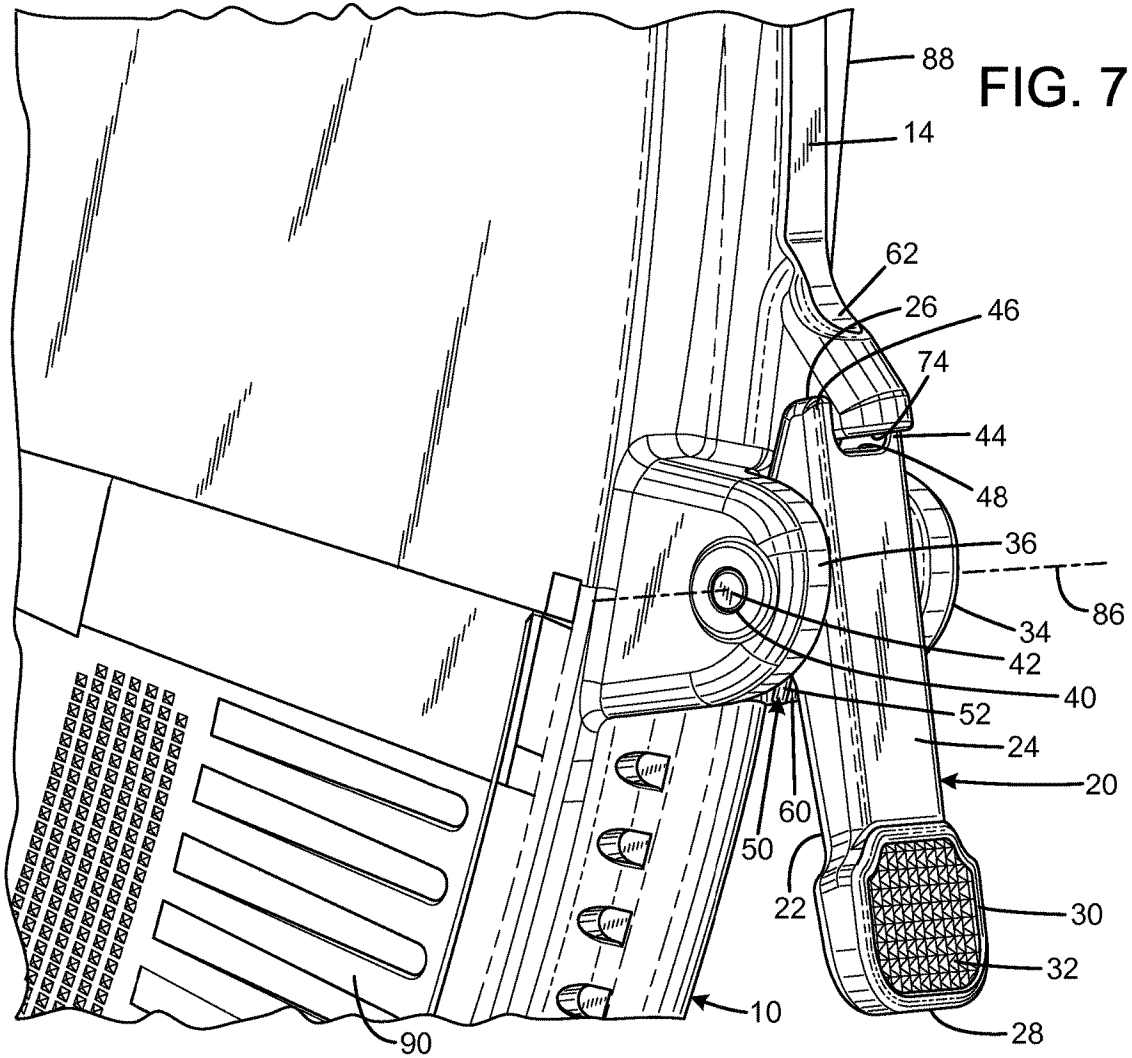
FIG. 7 is a rear isometric view of the current embodiment of the magazine with release lever actuator of FIG. 1.

FIG. 7 illustrates the improved magazine 10 of the present invention. More particularly, the slot 48 in the release lever actuator 20 is suitably wide such that right and left prongs 44, 46 can straddle the rear catch 58. The slot 48 is also suitably narrow such that right prong and left prong can contact the front 116 of the magazine latch when not in the "engaged position." The rear catch 58 has an upper cam surface 62 that is shaped to contact the cam surface 120 on the front 116 of the magazine latch when the magazine is being inserted into the SKS carbine 100. Specifically, the cam surface 62 urges the magazine latch rearward when the magazine is inserted so the bottom 74 of the rear catch can ascend above cam surface 120 and be received in the notch 122 when the magazine latch slides forward.

Figure 8:
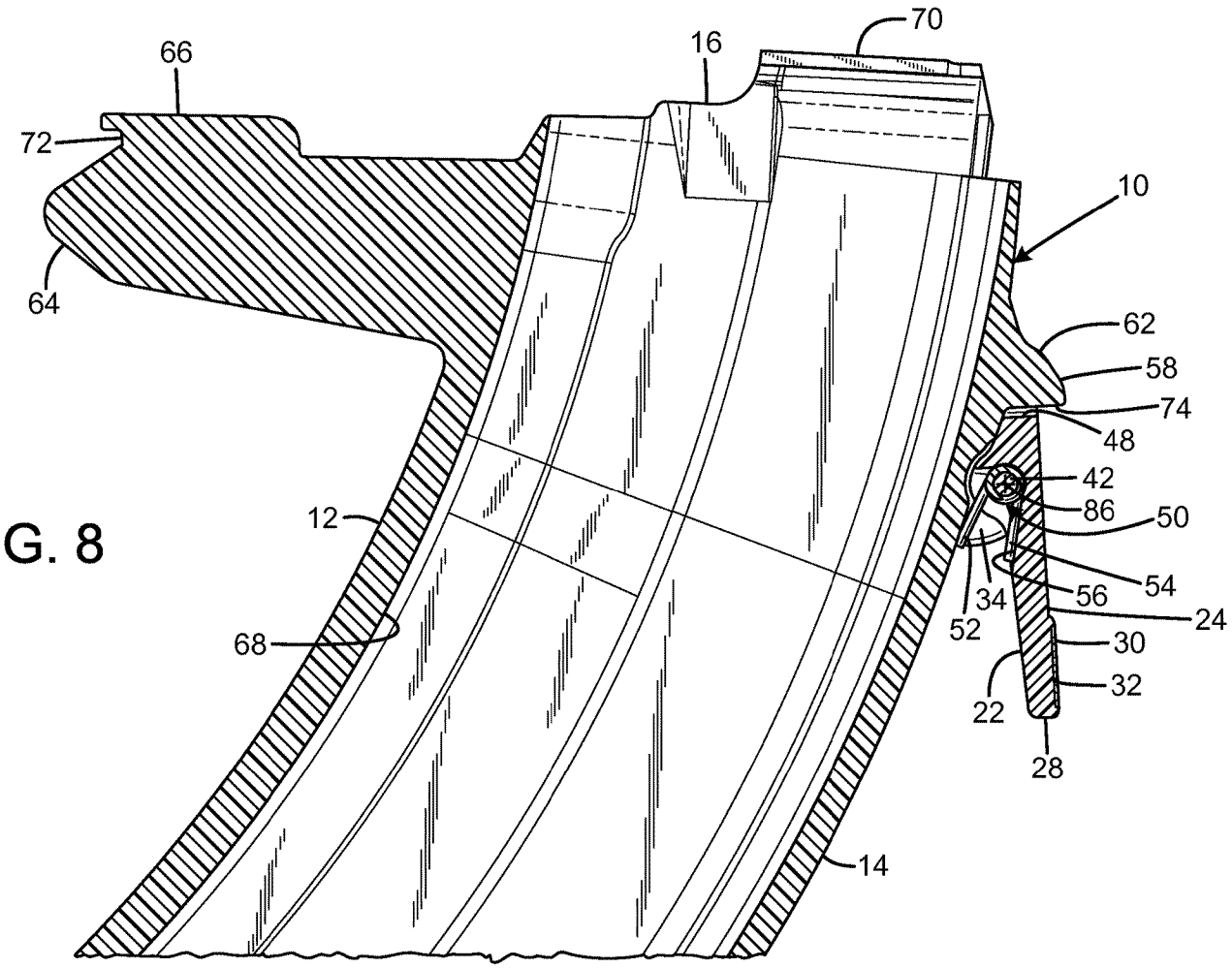
FIG. 8 is a left side sectional view of the current embodiment of the magazine with release lever actuator of FIG. 1.
Figure 14:
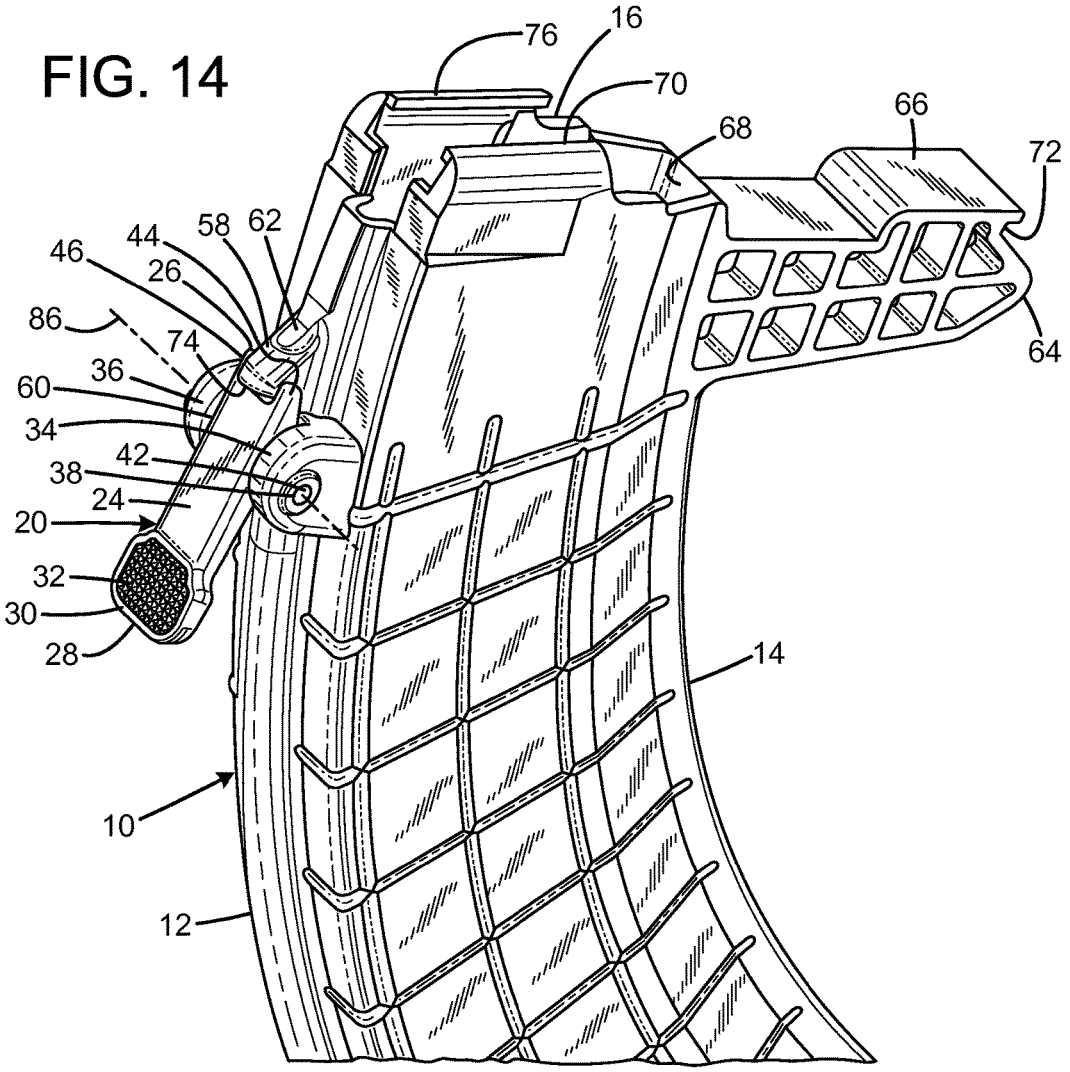
FIG. 14 is a right isometric view of the current embodiment of the magazine with release lever actuator of FIG. 1.
Figure 15:
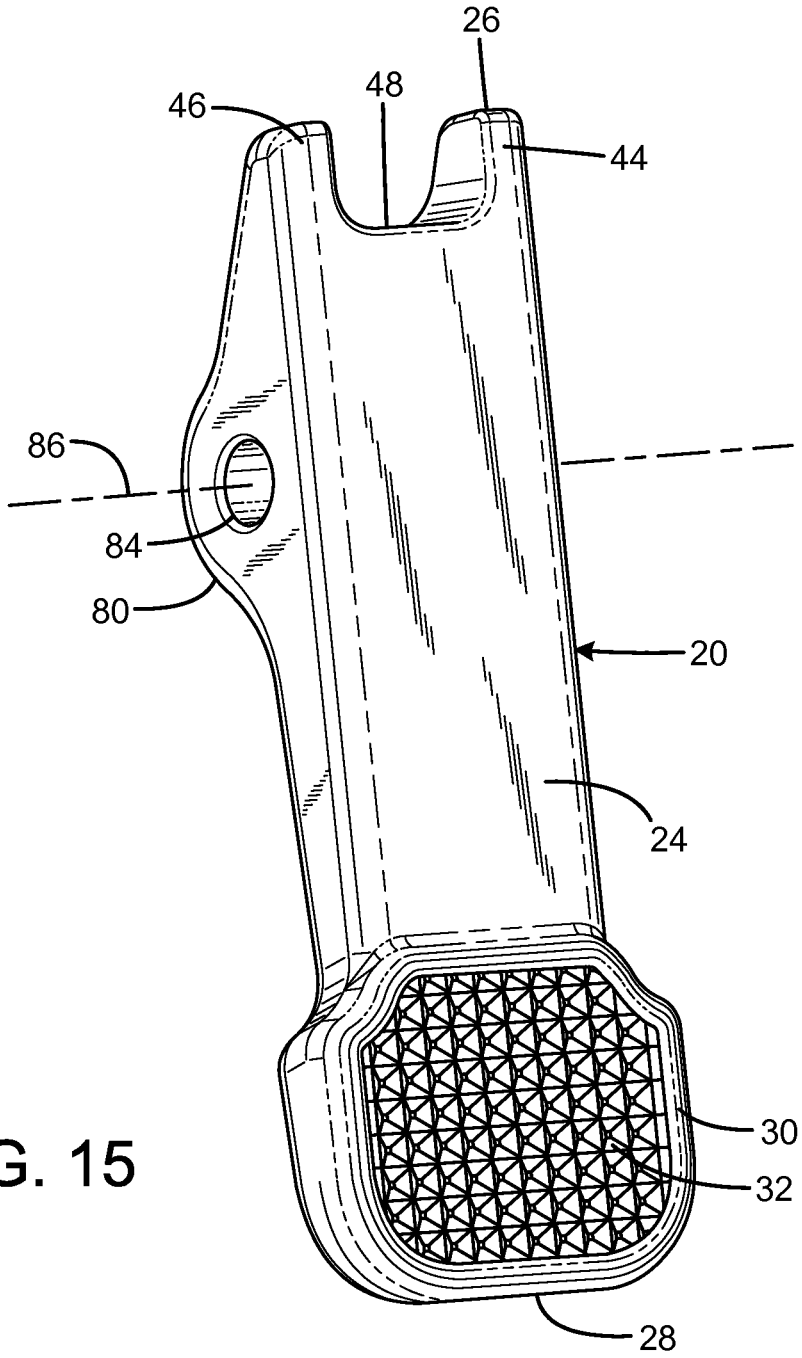
FIG. 15 is a rear isometric view of the current embodiment of the release lever actuator of FIG. 1.
Figure 16:
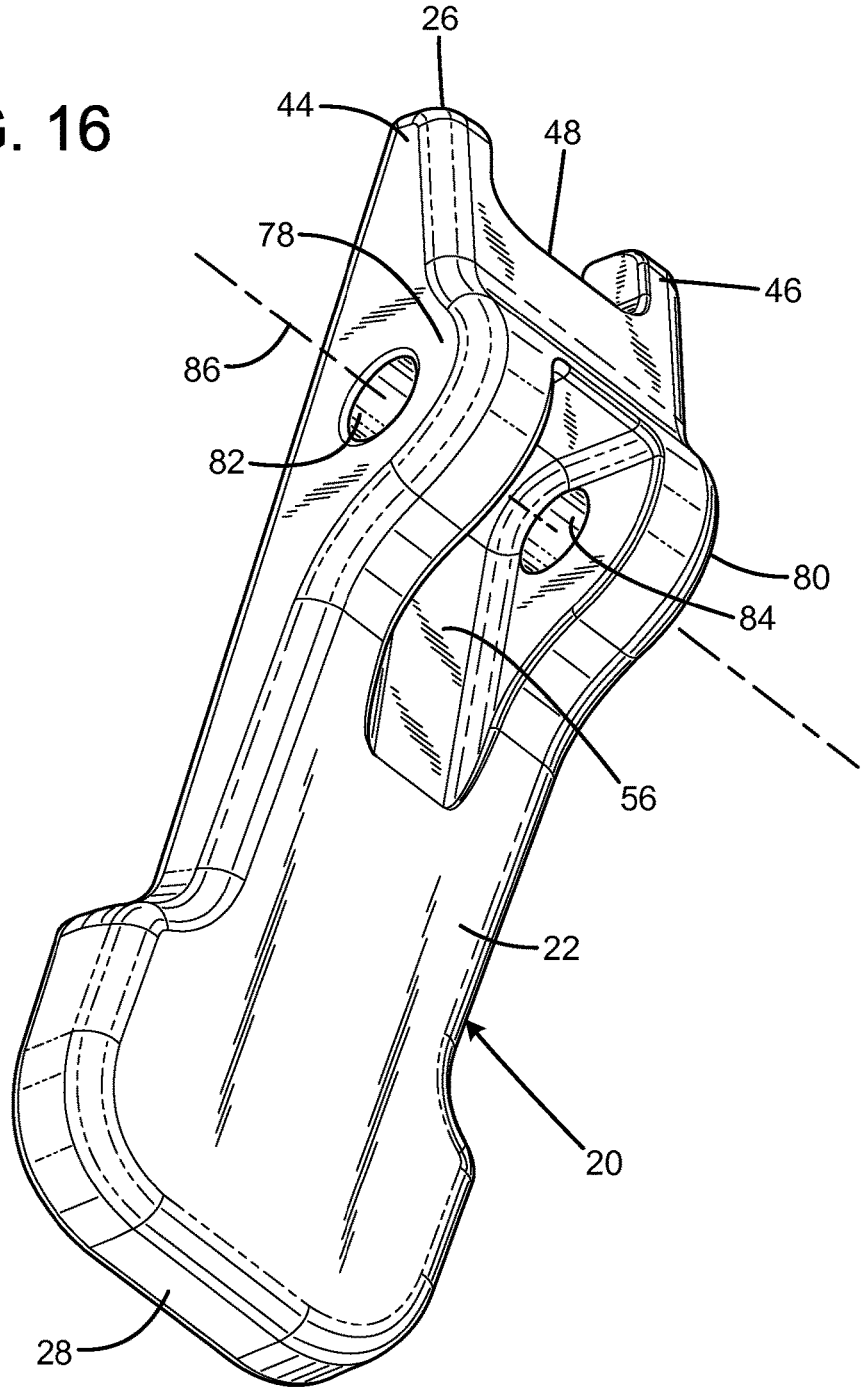
FIG. 16 is a front isometric view of the current embodiment of the release lever actuator of FIG. 1.
Figure 17:
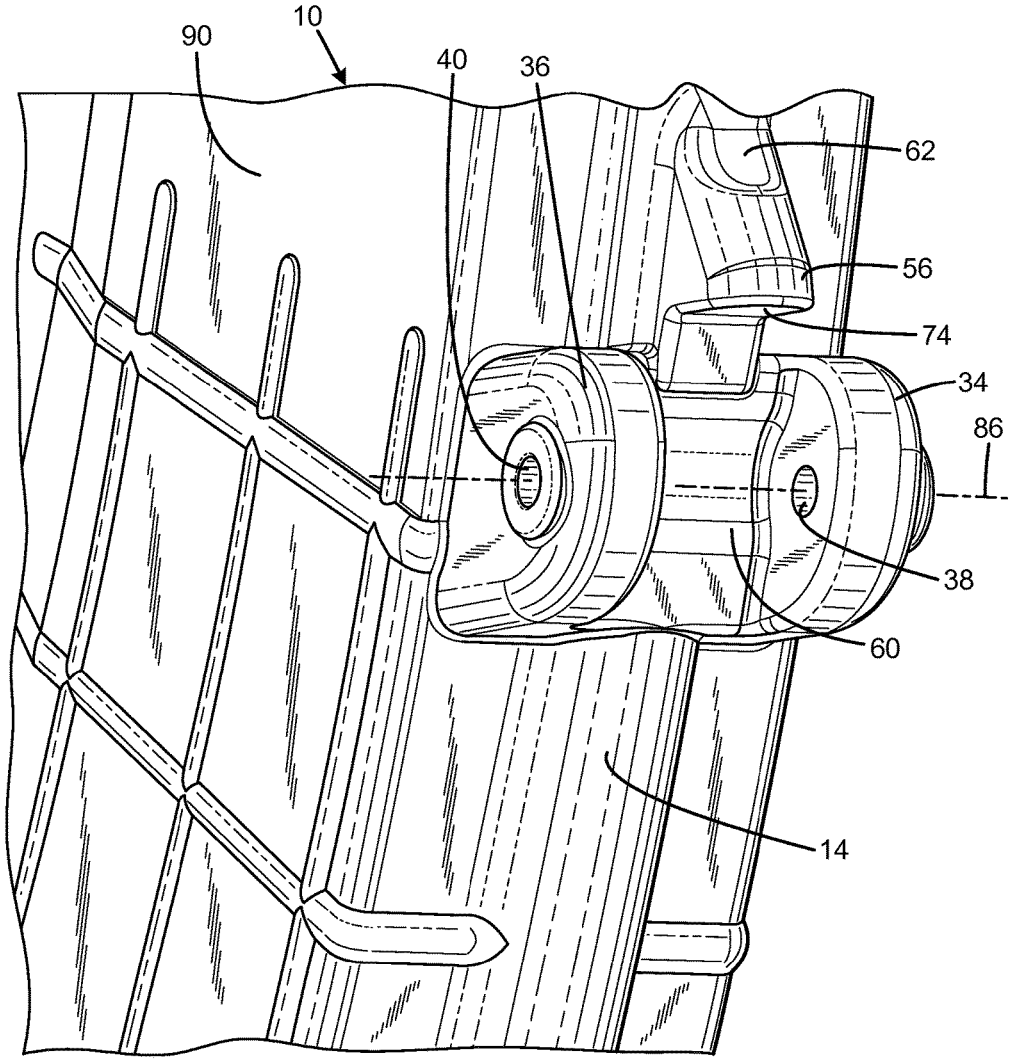
FIG. 17 is a rear isometric enlarged view of the current embodiment of the left and right ears of FIG. 1.

FIG. 8 illustrates the improved magazine 10 of the present invention. More particularly, the hollow interior 68 of the magazine and the right feed lip 70 at the top 16 of the magazine are visible. The left feed lip 76 is shown in FIG. 14.

Figure 9:
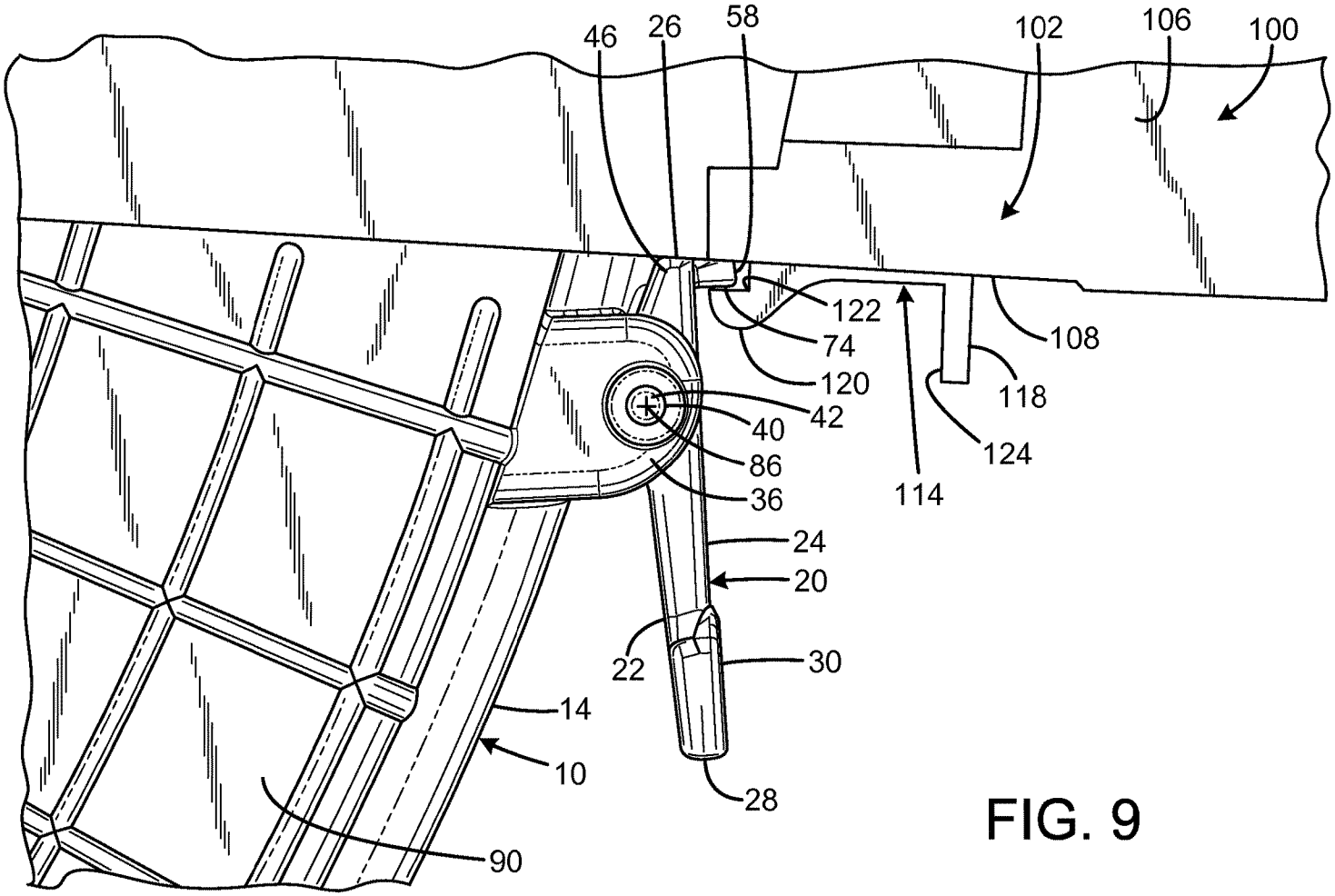
FIG. 9 is a left side view of the current embodiment of the magazine with release lever actuator of FIG. 1 installed on a SKS carbine. The SKS is shown in section.
Figure 10:
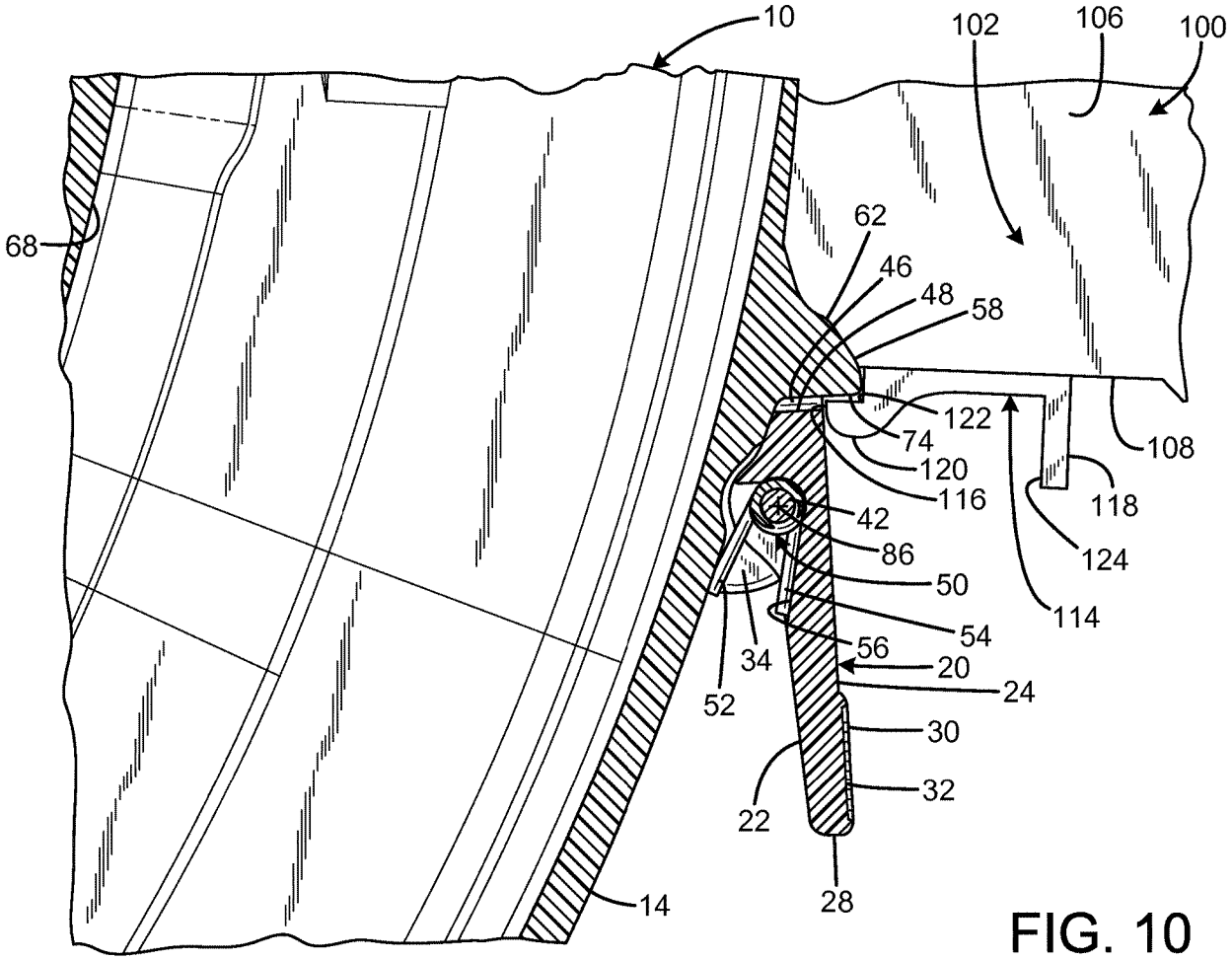
FIG. 10 is a left side sectional view of the current embodiment of the magazine with release lever actuator of FIG. 1 installed on a SKS carbine. The SKS is shown in section.

FIGS. 9-10 illustrate the improved magazine 10 of the present invention. More particularly, the release lever actuator 20 and magazine latch 114 are shown in the "engaged position." The front spring leg 52 and rear spring leg 54 of the torsion spring 50 are spread apart to their maximum extent, with the front spring leg contacting the rear 14 of the magazine and the rear spring leg being received within a pocket 56 in the front 22 of the release lever. The torsion spring pivots the release lever about the axle 42 until further movement is prevented by contact between the top 26 of the release lever and the rear of the magazine. In this position, the right prong 44 and left prong 46 straddle the rear catch 58, which is received within the slot 48. As a result, forward movement of the magazine latch 114 is not obstructed by the right and left prongs, which enables the magazine latch to occupy the "engaged position."

Figure 11:
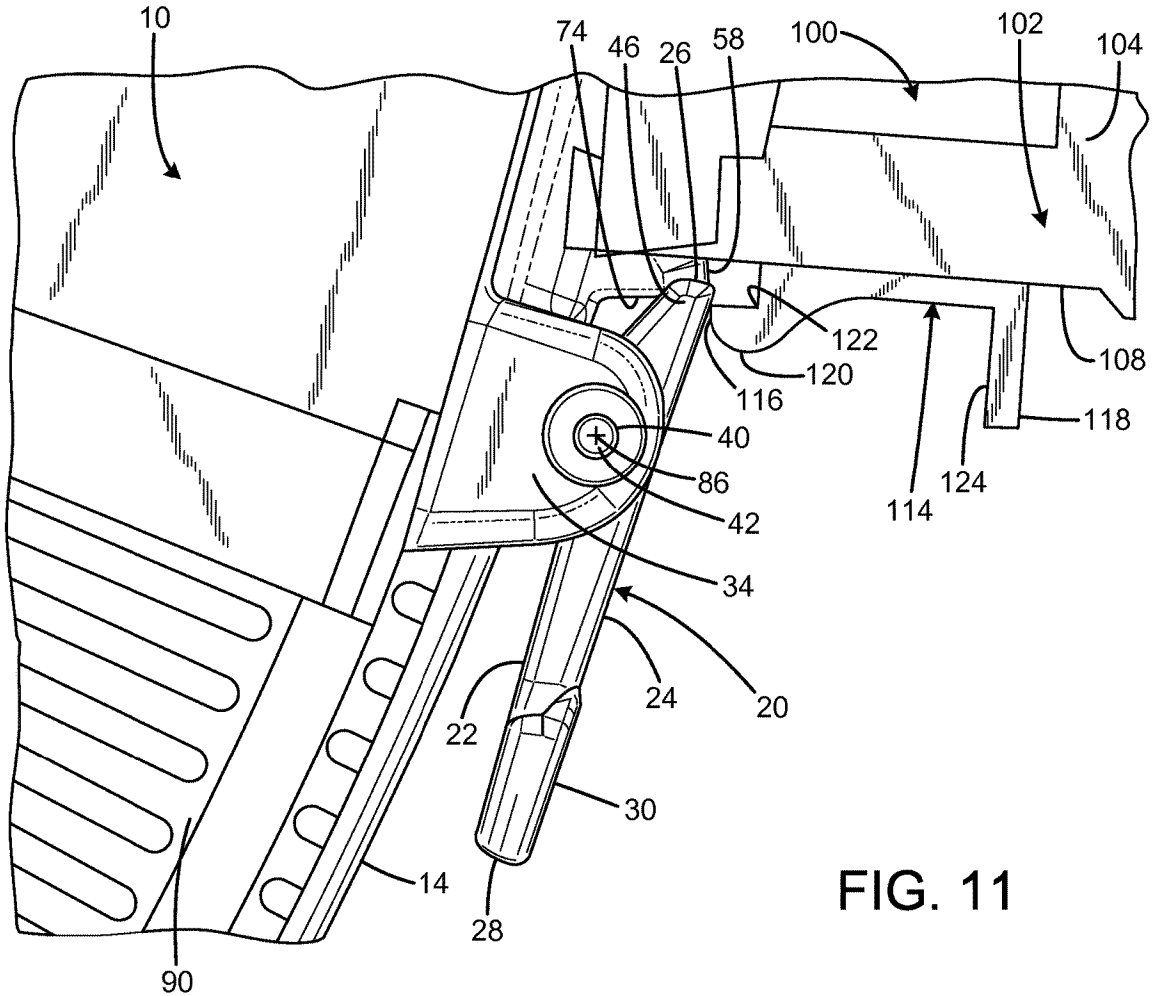
FIG. 11 is a left side view of the current embodiment of the magazine with release lever actuator of FIG. 1 installed on a SKS carbine with the release lever actuator partially disengaged from the SKS magazine catch. The SKS is shown in section.

FIG. 11 illustrates the improved magazine 10 of the present invention. More particularly, the release lever actuator 20 and magazine latch 114 are shown at the initiation of the disengagement procedure. The disengagement procedure only requires one hand of the user to grasp the front 12 of the magazine with the fingers and the thumb against the thumb pad 30. The use of the thumb to push forward to disengage the magazine eliminates the risk of an accidental trigger pull caused by inadvertently pulling the trigger 112 rearward instead of pulling the hook 124 of the magazine latch 114 rearward.

The thumb pad 30 has been depressed towards the rear 14 of the magazine 10 relative to FIGS. 9-10. Sufficient force has been applied to compress torsion spring 50 by reducing the distance between the front spring leg 52 and the rear spring leg 54. The release lever 20 has pivoted clockwise with respect to the position shown in FIGS. 9-10. The pivotal movement has brought the right prong 44 and left prong 46 of the release lever into contact with the front 116 of the magazine latch 114. At this point, the right prong and left prong have begun to exert force on the magazine latch to push the magazine latch rearward towards the "disengaged position." As the magazine latch moves rearward, the bottom 74 of the rear catch 58 begins to disengage from the notch 122 in the front 116 of the magazine latch.

Figure 12:
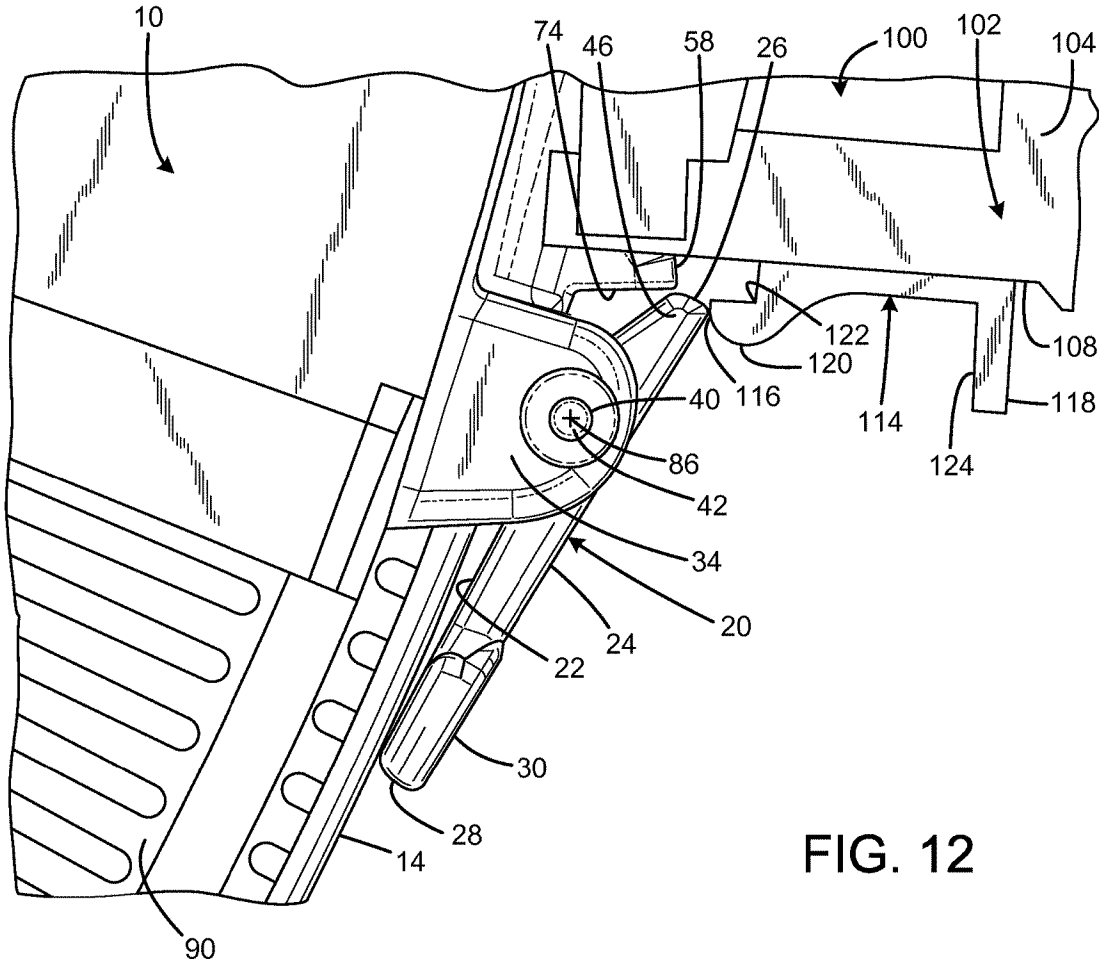
FIG. 12 is a left side view of the current embodiment of the magazine with release lever actuator of FIG. 1 installed on a SKS carbine with the release lever actuator fully disengaged from the SKS magazine catch. The SKS is shown in section.
Figure 13:
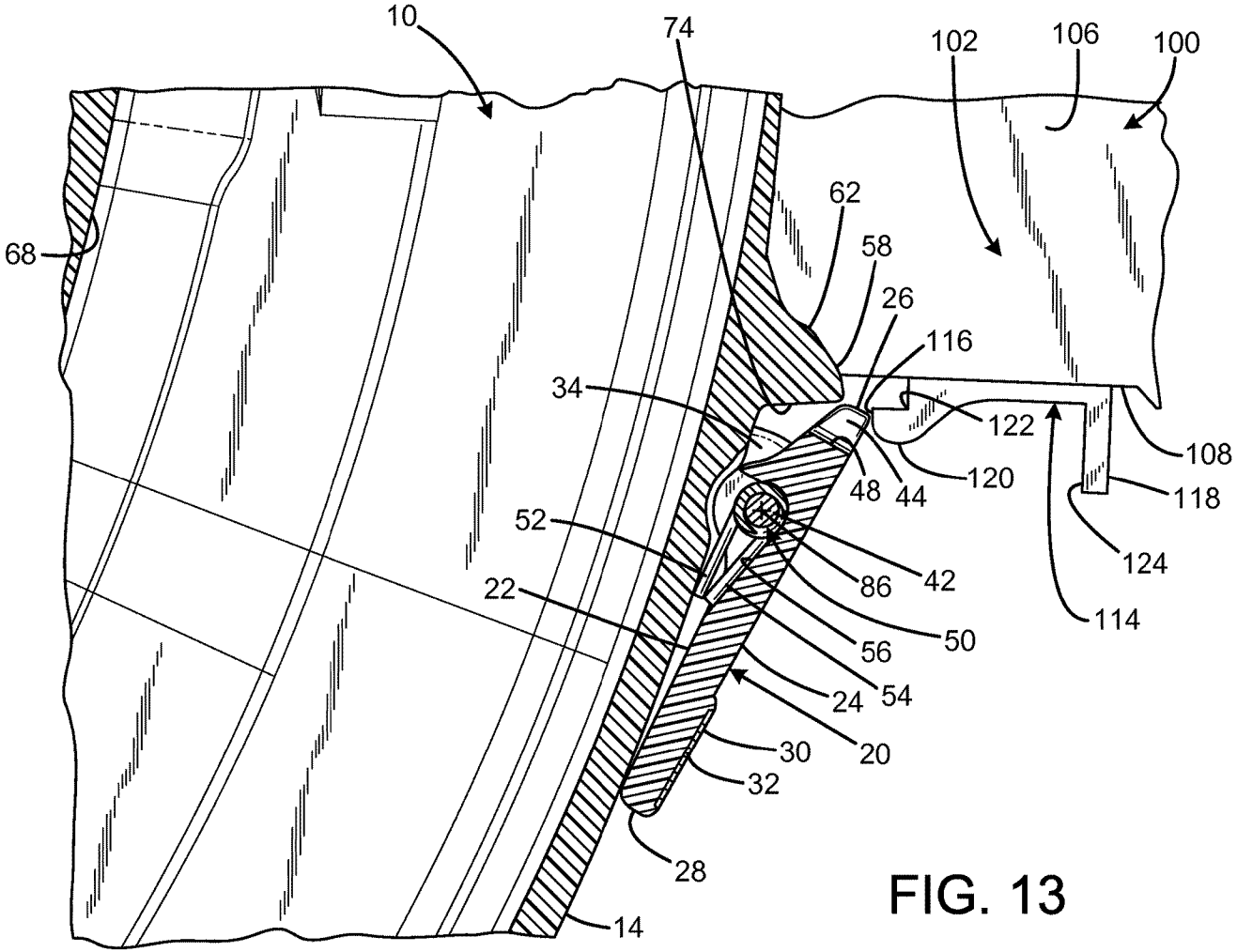
FIG. 13 is a left side sectional view of the current embodiment of the magazine with release lever actuator of FIG. 1 installed on a SKS carbine with the release lever actuator fully disengaged from the SKS magazine catch. The SKS is shown in section.

FIGS. 12-13 illustrate the improved magazine 10 of the present invention. More particularly, the release lever actuator 20 and magazine latch 114 are shown in the "disengaged position." The thumb pad 30 has been depressed until further movement is prevented by contact between the front 22 bottom 28 of the release lever and the rear 14 of the magazine. Sufficient force has been applied to fully compress torsion spring 50 by further reducing the distance between the front spring leg 52 and the rear spring leg 54. The release lever has pivoted clockwise with respect to the position shown in FIG. 11. The continued pivotal movement of the right prong 44 and left prong 46 pushed the magazine latch further rearward into the "disengaged position." In this position, the bottom 74 of the rear catch has fully disengaged from the notch 122 in the front 116 of the magazine latch. As a result, downward movement of the rear of the magazine is no longer prevented by contact between the bottom of the rear catch and the magazine latch 114. Once the magazine 10 has lowered sufficiently for the cam surface 120 on the front 116 of the magazine latch to clear the top 26 of the release lever so the cam surface 120 can contact the cam surface 62 on the rear catch, the force of the magazine latch returning to the engaged position pushes the rear catch downward. As a result, the magazine latch provides positive spring assist to facilitate removal of the magazine from the SKS carbine 100.

Figure 18:
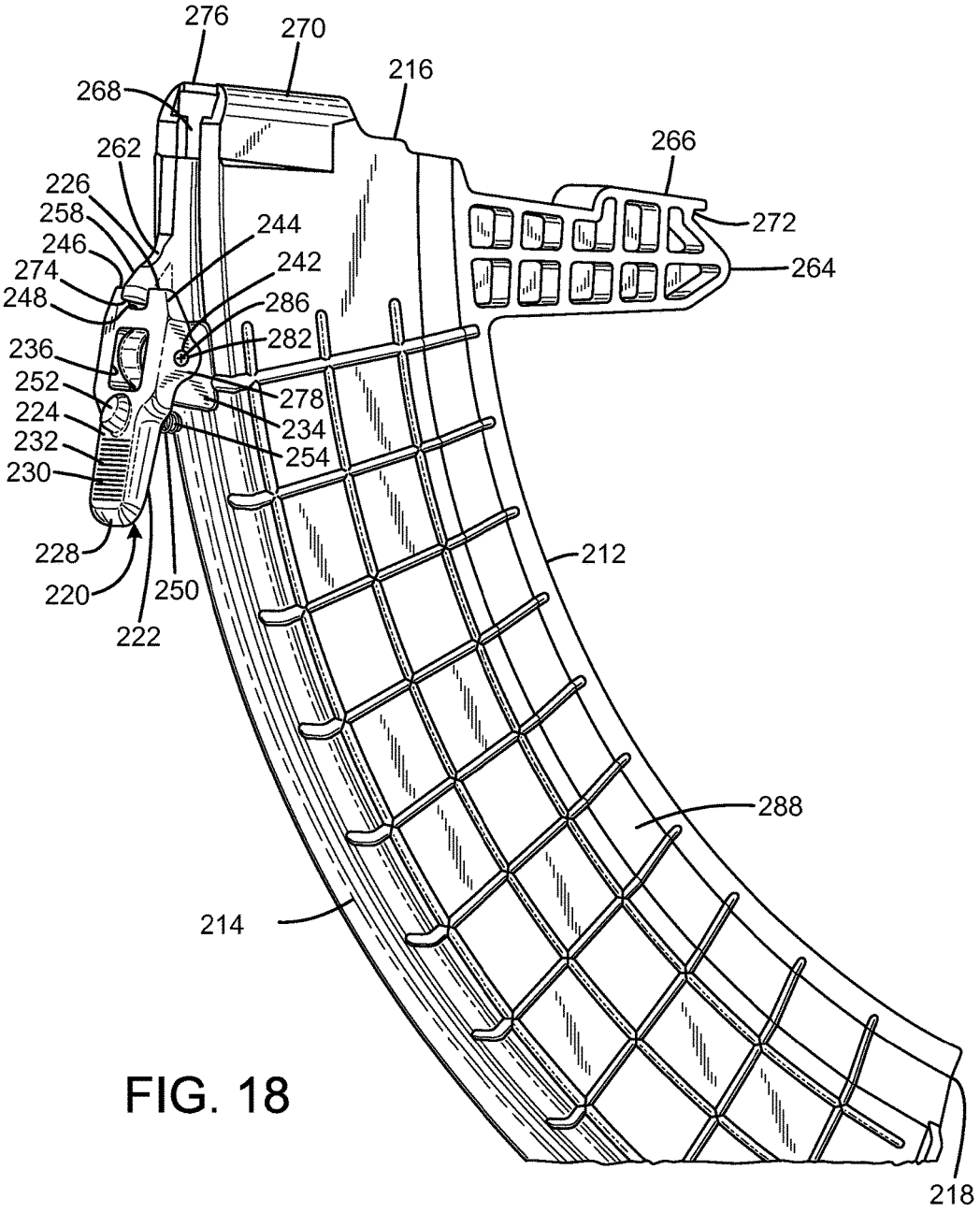
FIG. 18 is a rear isometric view of an alternative embodiment of the magazine with release lever actuator constructed in accordance with the principles of the present invention.
Figure 19:
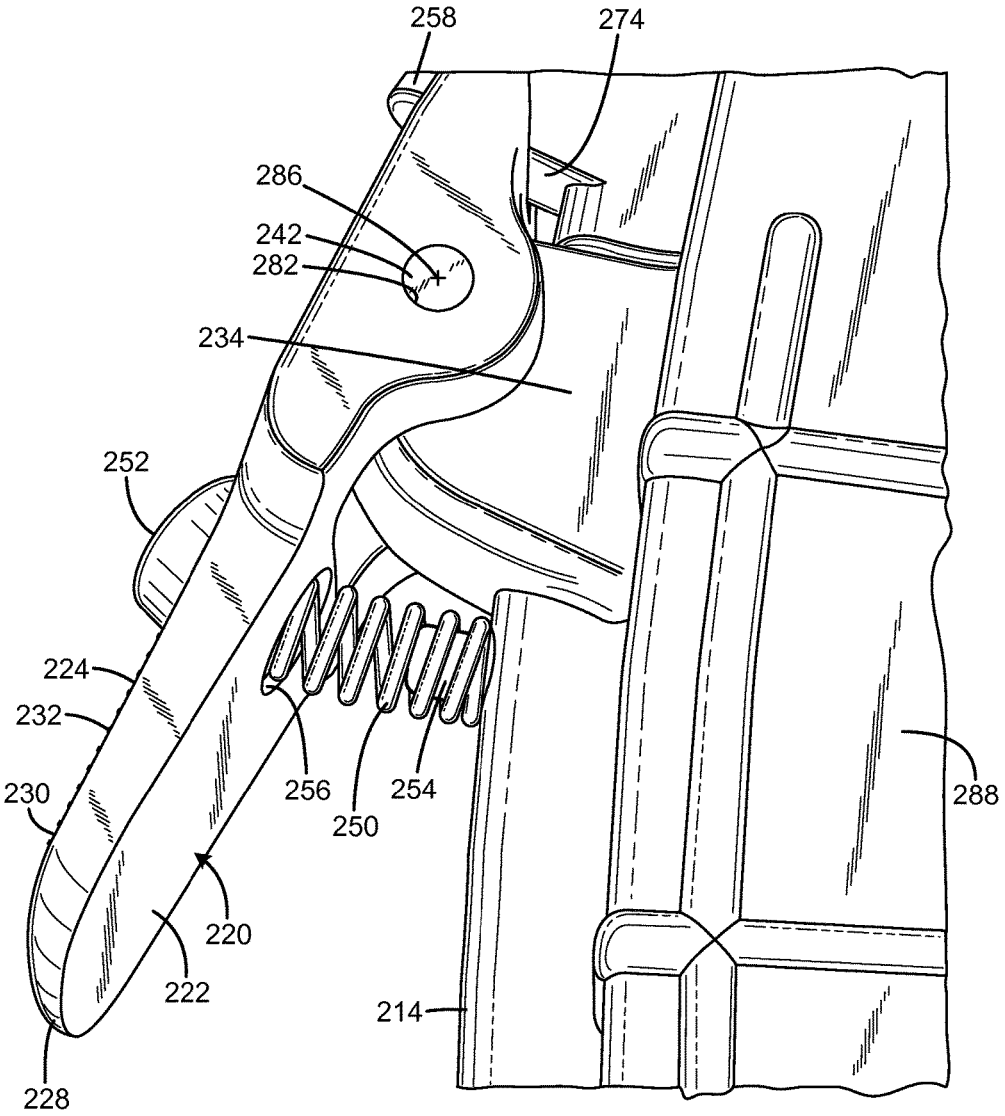
FIG. 19 is a rear isometric enlarged view of the alternative embodiment of the release lever of FIG. 18.

FIGS. 18 and 19 illustrate an alternative embodiment of the improved magazine with release lever actuator 200 of the present invention. More particularly, the magazine is generally tubular and has a front 212, rear 214, top 216, bottom 218, and major planar right and left side walls 288, 290. The rear of the magazine is an elongated wall that includes a rear protrusion 234 and a post 254. The rear protrusion defines a bore (not visible). The middle portion (not visible) of an axle 42 is received within the bore in the rear protrusion. A rear catch 258 having a bottom 274 protrudes rearwardly from the rear of the magazine above the rear protrusion. A front magazine extension 264 protrudes forwardly from the top front of the magazine. The front magazine extension has a top 266 that defines a forward facing notch 272. The magazine has a hollow interior 268, and includes right feed lip 270 and left feed lip 276 at the top of the magazine. The right feed lip and left feed lip serve to guide the uppermost cartridge (not shown) into the SKS carbine 100 as shown in FIG. 1 as the cartridge emerges upwards from the interior of the magazine.

A release lever actuator 220 is pivotally mounted to the magazine 200 on the axle 442. The release lever has a front 222, rear 224, top 226, and bottom 228. The top front of the release lever includes a right ear 278 and a left ear 280. The right ear and left ear are separated from one another by an aperture 236 that receives the rear protrusion 234. The right ear defines a right aperture 282, and the left ear defines a left aperture 284. The axle 242 is received within the right and left apertures 282, 284 and defines a pivot axis 286. The pivot axis is perpendicular to the right and left side walls 288, 290 of the magazine. A bore 256 is defined by the front of the release lever below the right and left ears 278, 280. The rear of the bottom of the release lever defines a thumb pad 230 with ridges 232. The ridges prevent a user's thumb from inadvertently sliding off of the thumb pad. The top of the release lever defines a right prong 244 and a left prong 246 separated by a slot 248. A coil spring 250 has one end mounted on the post 254 and an opposed end received within the bore 256 between the rear 214 of the magazine and the front 222 of the release lever. The bore extends into a rearward facing dimple 252 on the rear of the release lever so that the bore has sufficient depth to receive a sufficient portion of the opposed end of the coil spring. The coil spring biases the top of the release lever forwardly towards the rear of the magazine and biases the bottom of the release lever rearwardly away from the rear of the magazine (the "engaged position" the release lever assumes when the magazine is installed on a SKS carbine 100).

When the alternative embodiment of the magazine 200 is installed in the SKS carbine 100, both the magazine latch 114 and the release lever actuator 220 are in the "latched/engaged position." The top 226 of the release lever is pivoted forward into contact with the rear 214 of the magazine such that the magazine latch can assume the magazine latch's forwardmost position. The bottom 274 of the rear catch is received within the notch 122 in the front 116 of the magazine latch. The front of the magazine latch obstructs downward movement of the rear catch, thereby releasably retaining the top 216 rear 214 of the magazine within the bottom 108 of the lower receiver 102. The top 266 of the front magazine extension 264 is releasably retained within the slot 126 in the bottom of the lower receiver by the engagement of magazine retainer 128 within notch 272. The magazine retainer secures the front of the original SKS box magazine, and no modification of the magazine retainer is required for use with the magazine 200.

Figure 20:
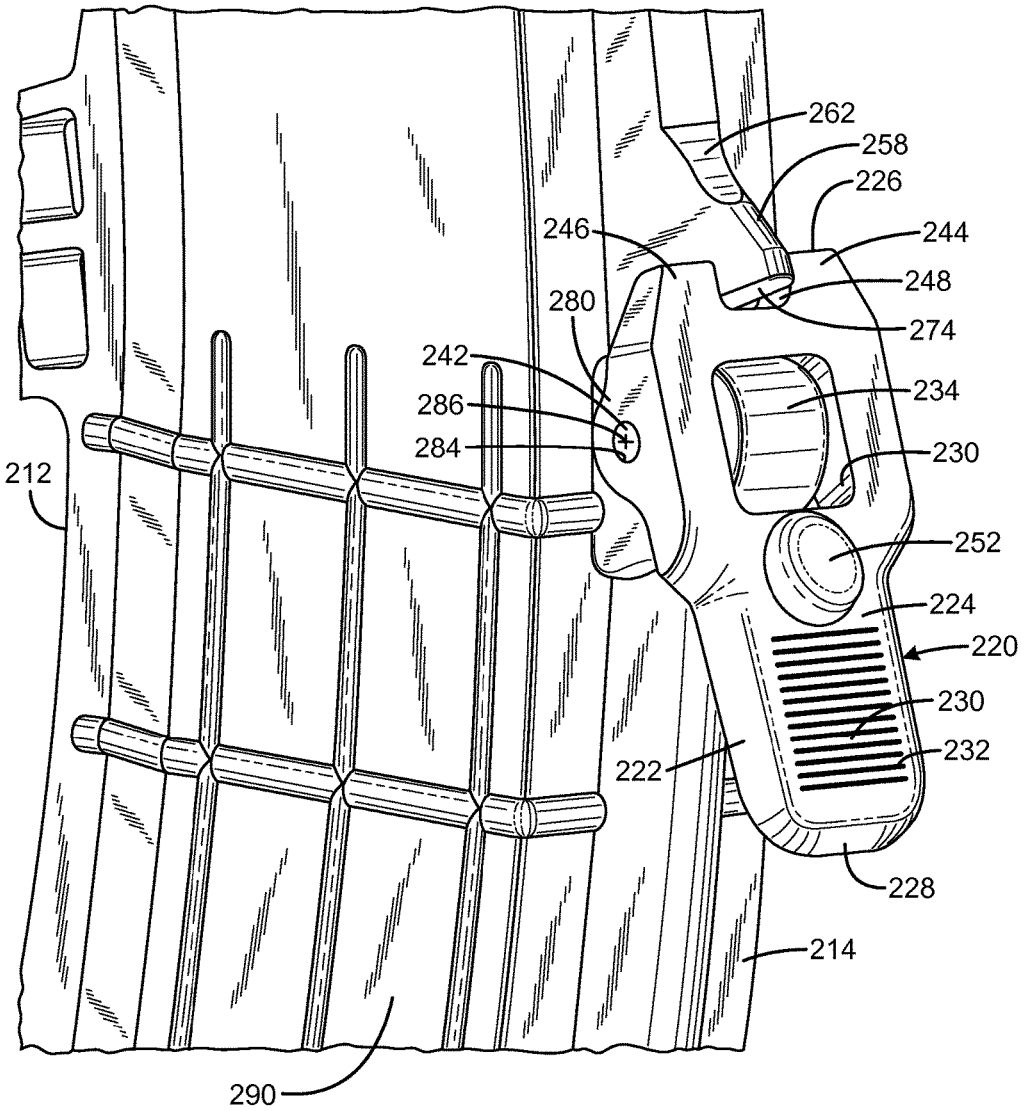
FIG. 20 is a right isometric enlarged view of the alternative embodiment of the release lever of FIG. 18.

FIG. 20 illustrates alternative embodiment of the improved magazine 200 of the present invention. More particularly, the slot 248 in the release lever actuator 20 is suitably wide such that right and left prongs 244, 246 can straddle the rear catch 258. The slot 248 is also suitably narrow such that right prong and left prong can contact the front 116 of the magazine latch when not in the "engaged position." The rear catch 258 has an upper cam surface 262 that is shaped to contact the cam surface 120 on the front 116 of the magazine latch when the magazine is being inserted into the SKS carbine 100. Specifically, the cam surface 262 urges the magazine latch rearward when the magazine is inserted so the bottom 274 of the rear catch can ascend above cam surface 120 and be received in the notch 122 when the magazine latch slides forward.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While current embodiment 2 of a magazine with release lever actuator have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, although a torsion spring biasing the release lever has been described, any suitable biasing mechanism can be used, including coil and flat springs.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A magazine for a rifle having a magazine release latch movable between a secured position in which a magazine is secured in the rifle and a released position in which the magazine is removable from the rifle, the magazine comprising:

a magazine body defining a chamber for receiving ammunition;

the body having a catch feature adapted for selectable engagement by the magazine release latch;

a latch actuator element mounted to the magazine body proximate to the catch feature; and the latch actuator element being movable with respect to the body such that movement of the latch actuator element motivates the magazine release latch from the secured position to the released position.

2. The magazine of claim 1 wherein the latch actuator element is pivotally connected to the magazine body.

3. The magazine of claim 1 wherein the latch actuator element has a first portion proximate the catch feature, and a second portion remote from the catch feature.

4. The magazine of claim 3 wherein the latch actuator element an intermediate portion pivotally connected to the magazine body.

5. The magazine of claim 4 wherein the magazine has major planar sidewalls, and wherein the latch actuator element pivots on a pivot axis perpendicular to the sidewalls.

6. The magazine of claim 3 wherein the first portion moves rearward in response to moving the second portion forward, such that forward and grasping pressures on the magazine at the second portion release the magazine.

7. The magazine of claim 3 wherein the first portion includes opposed spaced apart protrusions, with the catch feature received therebetween.

8. The magazine of claim 1 wherein the latch actuator element is spring biased to a resting position, such that movement of the latch actuator element to motivate the magazine release latch requires pressure against the spring biasing force.

9. The magazine of claim 1 wherein the magazine is a tubular body having an elongated rear wall, and the latch actuator element is mounted to the rear wall.

10. The magazine of claim 1 wherein the latch actuator element is responsive to pressure in a forward direction to release the magazine release latch.

11. The magazine of claim 1 wherein the latch actuator element includes opposed spaced apart protrusions, with the magazine release catch received therebetween.

* * * * *